US006835125B1

(12) United States Patent
Tseng et al.

(10) Patent No.: US 6,835,125 B1
(45) Date of Patent: Dec. 28, 2004

(54) RETAINER WITH A WEAR SURFACE FOR CHEMICAL MECHANICAL POLISHING

(75) Inventors: Ming-Kuei Tseng, San Jose, CA (US); Michael Richter, Santa Rosa, CA (US); Steven M. Zuniga, Soquel, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/327,235

(22) Filed: Dec. 20, 2002

Related U.S. Application Data

(60) Provisional application No. 60/343,879, filed on Dec. 27, 2001.

(51) Int. Cl.[7] ..... B24B 47/02

(52) U.S. Cl. ..... 451/398; 451/41; 451/177; 451/285; 451/286; 451/287; 451/288; 451/388

(58) Field of Search ..... 451/41, 177, 285, 451/286, 287, 288, 389, 388, 399

(56) References Cited

U.S. PATENT DOCUMENTS

| | | | | |
|---|---|---|---|---|
| 5,205,082 A | | 4/1993 | Shendon et al. | |
| 5,423,558 A | | 6/1995 | Koeth et al. | |
| 5,584,751 A | | 12/1996 | Kobayashi et al. | |
| 5,605,488 A | | 2/1997 | Ohashi et al. | |
| 5,635,083 A | | 6/1997 | Breivogel et al. | |
| 5,643,061 A | | 7/1997 | Jackson et al. | |
| 5,645,474 A | | 7/1997 | Kubo et al. | |
| 5,695,392 A | | 12/1997 | Kim | |
| 5,759,918 A | | 6/1998 | Hoshizaki et al. | |
| 5,795,215 A | | 8/1998 | Guthrie et al. | |
| 5,851,140 A | | 12/1998 | Barns et al. | |
| 5,997,384 A | | 12/1999 | Blalock | |
| 6,019,670 A | | 2/2000 | Cheng et al. | |
| 6,251,215 B1 | | 6/2001 | Zuniga et al. | |
| 6,277,008 B1 | * | 8/2001 | Masuta et al. | 451/286 |
| 6,390,904 B1 | * | 5/2002 | Gleason et al. | 451/286 |
| 6,471,566 B1 | * | 10/2002 | Mikhaylich et al. | 451/41 |
| 6,585,850 B1 | * | 7/2003 | Kenji et al. | 156/345 |
| 6,602,114 B1 | * | 8/2003 | Wang et al. | 451/41 |

FOREIGN PATENT DOCUMENTS

| | | |
|---|---|---|
| EP | 0 747 167 | 12/1996 |
| EP | 0 841 123 A1 | 5/1997 |
| EP | 0 790 100 A1 | 8/1997 |
| GB | 1352932 | 5/1974 |
| GB | 2 307 342 | 5/1997 |
| GB | 2 336 121 | 10/1999 |

* cited by examiner

*Primary Examiner*—Joseph J. Hail, III
*Assistant Examiner*—Shantese McDonald
(74) *Attorney, Agent, or Firm*—Fish & Richardson

(57) ABSTRACT

A retaining ring has an inner core of a first material and an outer layer of a second, different material that is deposited on the first material. The outer layer can be deposited by spraying, e.g., by powder coating, and can be a polymer, e.g., polyetheretherketone.

21 Claims, 2 Drawing Sheets

RETAINER WITH A WEAR SURFACE FOR CHEMICAL MECHANICAL POLISHING

CROSS-REFERENCE TO RELATED APPLICATIONS

This application claims priority to provisional U.S. Application Ser. No. 60/343,879, filed on Dec. 27, 2001.

BACKGROUND

The present invention relates generally to chemical mechanical polishing of substrates, and more particularly to a carrier head for a chemical mechanical polishing apparatus.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load on the substrate to push it against the polishing pad. A polishing slurry, including at least one chemically-reactive agent and abrasive particles, if a standard pad is used, is supplied to the surface of the polishing pad.

The effectiveness of a CMP process may be measured by its polishing rate and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A recurring problem in CMP is the so-called "edge-effect," i.e., the tendency of the edge of the substrate to be polished at a different rate than the center of the substrate. The edge effect typically results in over-polishing (the removal of too much material from the substrate) at the substrate perimeter, e.g., the outermost five to ten millimeters of a 200-mm wafer.

Another problem is that the polishing pad contacts and abrades the bottom surface of the retaining ring. Eventually, the bottom surface retaining ring will be sufficiently worn away that the retaining ring needs to be replaced.

SUMMARY

In one aspect, the invention is directed to a retaining ring for a carrier head. The retaining ring has an inner core of a first material and an outer layer of a second, different material that is deposited on the first material.

Implementations of the retaining ring may include one or more of the following features. The outer layer may be deposited on the inner core by spraying. The outer layer may have a bottom surface for contacting a polishing pad during polishing. The second material may be less rigid than the first material. The second material may be a polymer, such as polyetheretherketone, and the first material may be a metal.

In another aspect, the invention is directed to a retaining ring for a carrier head. The retaining ring has an inner core made of a first material, and an outer layer of a second, different material that is configured to be replaced by redeposition.

Implementations of the retaining ring may include one or more of the following features. The outer layer may include a bottom surface for contacting a polishing pad during polishing.

In another aspect, the invention is directed to a method for assembling a retaining ring for a carrier head. The method includes providing an inner core of a first material, and depositing an outer layer of a second, different material onto an outer surface of the inner core.

Implementations of the retaining ring may include one or more of the following features. The outer layer may provide a bottom surface for contacting a polishing pad during polishing. The step of depositing may include spraying the second material onto the first material. The second material may be a polymer, such as polyetheretherketone. The deposition step may be a powder coating process or a dry finishing process.

In another aspect, the invention is directed to a method for repairing a retaining ring of a carrier head. The method includes providing a retaining ring having an inner core of a first material and an at least partially worn outer layer of a second, different material, and redepositing the second material of the outer layer on the retaining ring to refurbish the outer layer.

Implementations of the retaining ring may include one or more of the following features. The outer layer may provide a bottom surface for contacting a polishing pad during polishing. The redepositing step may include includes spraying the second material onto the retaining ring.

Other features, objects, and advantages of the invention will be apparent from the description and drawings, and from the claims.

DETAILED DESCRIPTION

Figure 1:
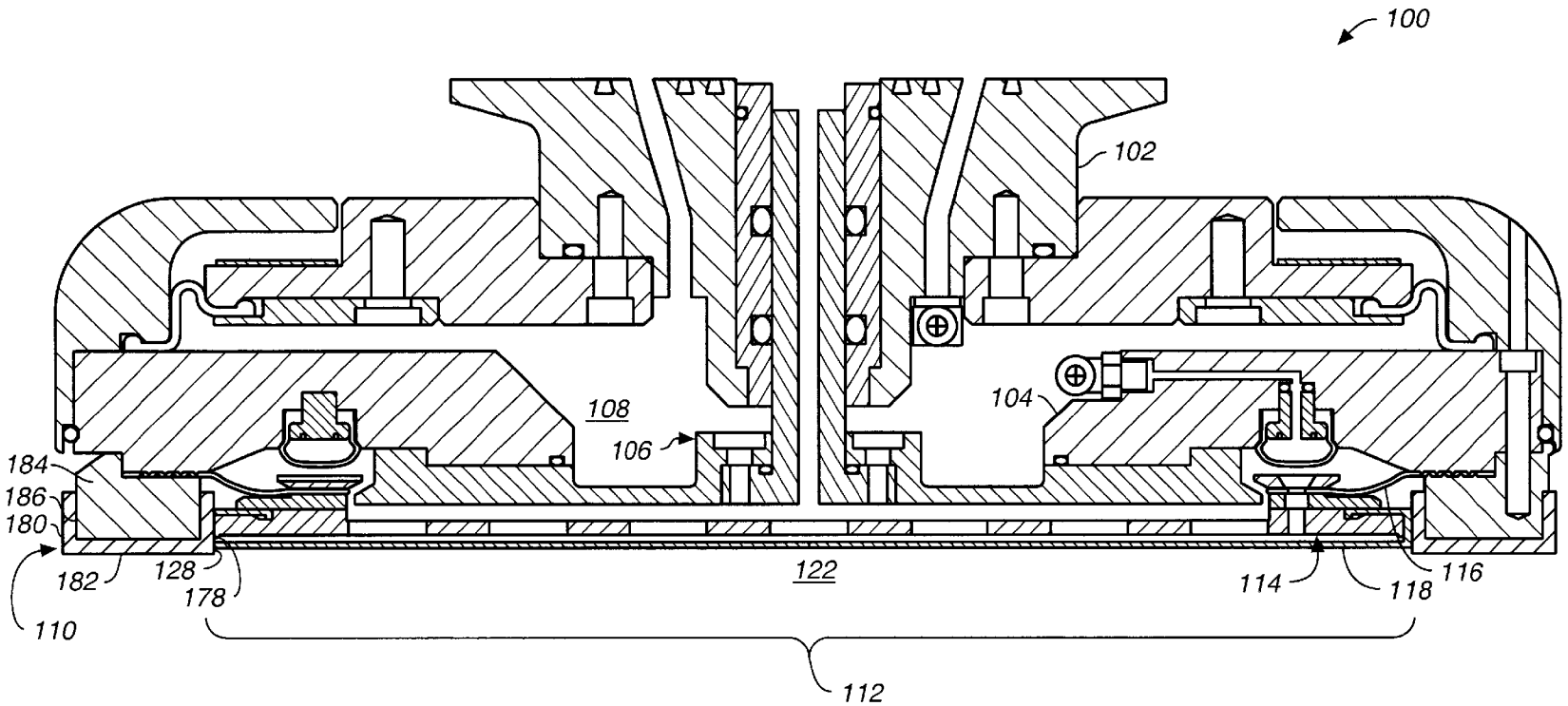
FIG. 1 is a schematic cross-sectional view of a carrier head according to the present invention.

Referring to FIG. 1, one or more substrates 10 will be held in by a carrier head 100 in a chemical mechanical polishing (CMP) apparatus. A description of a suitable CMP apparatus may be found in U.S. Pat. No. 5,738,574, the entire disclosure of which is hereby incorporated by reference.

As illustrated, carrier head 100 includes a housing 102, a base 104, a gimbal mechanism 106 (which can be considered part of the base 104), a loading chamber 108, a retaining ring 110, and a substrate backing assembly 112. The backing assembly 112 can include a flexible membrane 118 with a mounting surface 120. A description of a similar carrier head may be found in U.S. Pat. No. 6,183,354, the entire disclosure of which is hereby incorporated by reference.

Retaining ring 110 may be a generally annular ring secured at the outer edge of base 104, e.g., by bolts 194 (only one is shown in the cross-sectional view of FIG. 1). When fluid is pumped into loading chamber 108 and base 104 is pushed downwardly, retaining ring 110 is also pushed downwardly to apply a load to polishing pad 32. An inner surface 128 of retaining ring 110 defines, in conjunction with mounting surface 120 of flexible membrane 118, a substrate receiving recess 122. The retaining ring 110 prevents the substrate from escaping the substrate receiving recess.

Figure 2:
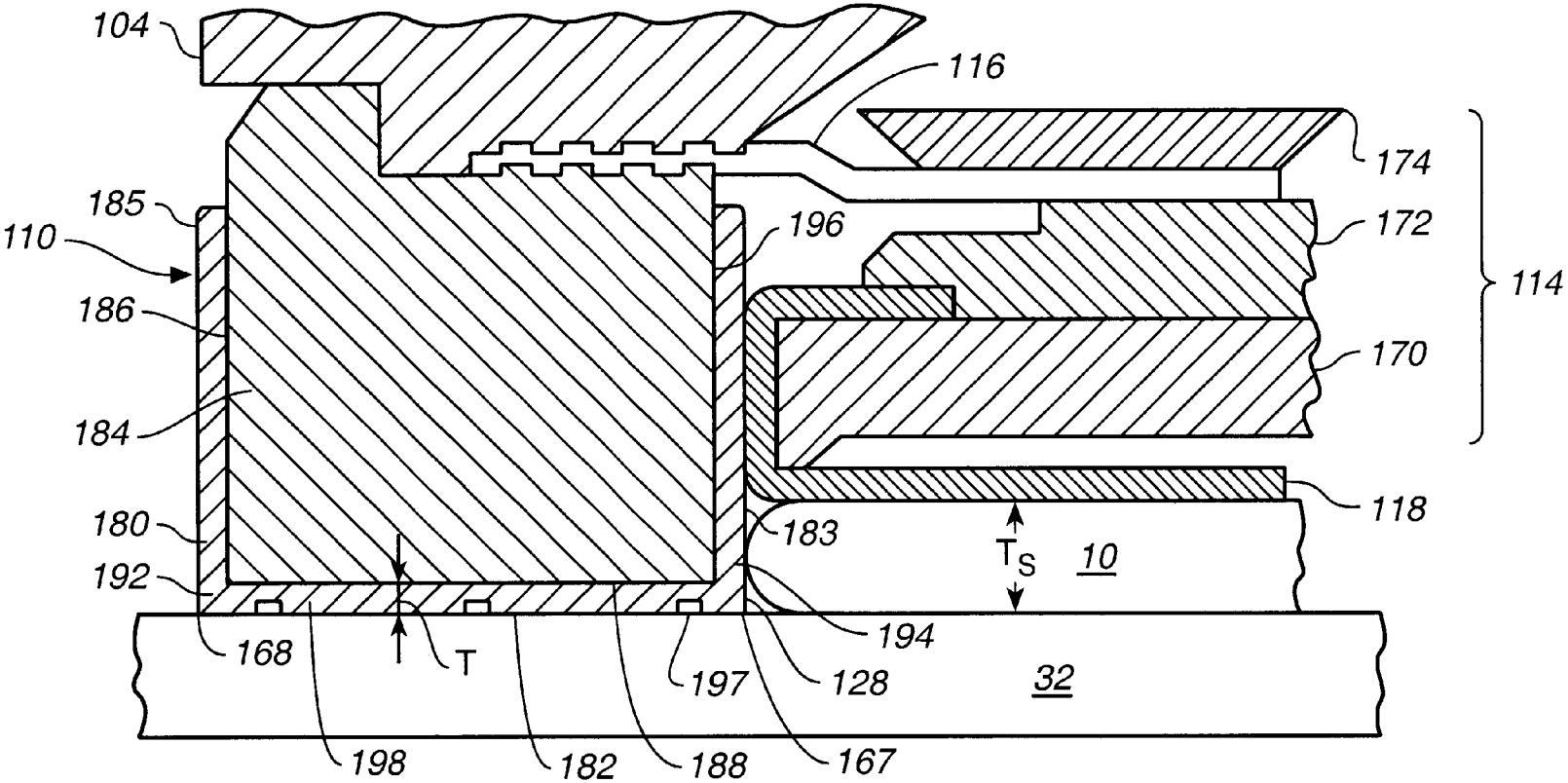
FIG. 2 is an enlarged view of the carrier head of FIG. 1 showing a retaining ring with a core and an layer deposited on the core.

Referring to FIG. 2, retaining ring 110 has multiple sections, including an annular inner core 184 connected to the base 104 and an outer layer 180 that covers at least part of the outer surface of the inner core 184. The outer surface of the inner core 184 can include a lower surface 188, an outer surface 186 and an inner surface 182. A lower portion 198 of the layer 180 can cover the bottom surface 188 to provide a bottom surface 182 for contacting the polishing pad. An inner layer portion 194 of the layer 180 can cover the inner surface 182 of the inner core 184 to provide an inside surface 183 for contact with the substrate. An outer layer portion 192 of the layer 180 can cover the outer surface 186 of the inner core to provide an outside perimeter surface 185 for protection of the outer surface of the retaining ring.

To manufacture the retaining ring 110, the outer layer 180 is deposited on the inner core 184. A deposition process, in which the outer layer is formed by gradual material accumulation on the outer surface of the core, can be distinguished from conventional attachment processes, in which a preformed layer is secured to the core, e.g., by adhesives or mechanical attachments, such as bolts or screws.

For example, the material of the outer layer 180 can be deposited on the outer surface of the inner core 184 by using a technique of powder coating, which involves a cold dry powder deposition process discussed in detail below. The outer layer 180 can be formed of various polymeric materials, finely ground, which are electrostatically charged and sprayed onto the retaining ring. The retaining ring is electrostatically grounded so that the charged powder particles projected (sprayed) by an applicator (not shown) at the retaining ring 110 adhere to the retaining ring. The charged powder particles are held on the retaining ring until melted and fused in the curing oven into an uniform coating composing the outer layer 180. Alternatively, the outer layer 180 can be formed on the inner core 184 by other material deposition processes, such as chemical vapor deposition, polycondensation or electroplating.

The outer layer 180 should be formed of a material that is less rigid than the material of the inner core 184. Specifically, the inner diameter portion 194 of the outer layer 180 should be sufficiently elastic that contact of the substrate edge against the outer layer of the retaining ring does not cause the substrate to chip or crack. On the other hand, the inner diameter portion 194 should not be so elastic that downward pressure on the retaining ring causes the outer layer 180 to extrude into substrate receiving recess 122.

The outer layer 180 also can be durable, but it is acceptable for the outer layer material to have a wear rate higher that the wear rate of the inner core material. Thus, during polishing, the outer layer 180 can be worn away at a higher rate than would be required for the retaining ring without the outer layer. The outer layer 180 may be made of a polymer, such as an epoxy or an epoxy-polyester hybrid. For example, the outer layer can be a polyetheretherketone available under the trade name PEEK™ from Victrex and also available from Powder Craft, Inc., Georgia. Other polymers, known under the trade names Aromatic-Urethane, TGIC-Polyester and Aliphatic-Urethane and available from Dupont of Wilmington, Del., may be suitable.

The thickness T of the outer layer 180 can be sufficient for at least a conventional number of polishing cycles. The thickness T can be selected as an the maximum thickness achievable given a selected depositing process and a polymer. Specifically, the initial thickness of the outer layer 180 should be at least 60 mils and can be between about 80 and 90 mils.

Without being limited to any particular theory, the flatness of the bottom surface 182 of the retaining ring and the sharpness of the corners 167 and 168 formed between the bottom surface 182 and the inside surface 183 and outside surface 185, respectively, may be related to the edge effect. Specifically, if the bottom surface is very flat, the edge effect can be reduced. Because the process of spraying the polymer on the retaining ring is relatively non-precise, the surfaces of the outer layer 180 can be slightly deformed. This deformation can result in a nonplanar bottom surface 182, which might increase the edge effect. Additionally, the lateral force of the rotating polishing pad during polishing tends to urge the substrate against the retaining ring. If the outer layer 180 has a rounded inner corner 167, the substrate might be forced under the rounded edge of the retaining ring and slip out. To ensure that the tolerances required in the substrate polishing process are complied with and to preserve the sharpness of the corners 167 and 168 and the flatness of the bottom surface 182, the retaining ring can be lapped or machined after installation on the carrier head.

The lower portion of the outer layer 180 should also have a height H larger than the thickness $T_s$ of the substrate. Specifically, the outer layer 180 should be thick enough that the substrate does not brush against the rigid material of the inner core 184 when the substrate contacts the inner surface 196.

Due to the high wear rate of the outer layer material, the thickness of the outer layer 180 can decrease rapidly. When the outer layer 180 has been worn away to a minimum acceptable thickness, the retaining ring can be refurbished. Specifically, the outer layer 180 is replaced when it has a remaining thickness of about 20 mils or when the remaining height H is equal to the substrate thickness.

The outer layer 180 can be repaired or replaced by redepositing the same outer layer material on the worn or damaged portions of the surfaces 182, 183 and 185 using the same powder-coating process used to deposit the original outer layer 180 on the inner core 184.

The bottom surface 182 of the outer layer 180 can be substantially flat, or it can have a plurality of grooves 197 to facilitate the transport of slurry from outside the retaining ring to the substrate. Additionally, the bottom surface can include one or more outlets (not shown) in the surface 182 of the retaining ring which can be fluidly connected to an air source through channels (not shown) in the retaining ring inner core 184. If not protected, these channels can be blocked or obstructed by the sprayed-on depositing of the outer layer material directly on the grooves or outlets in the surface 182. A protective measure, such as a hard masking technique, for example, can be used to protect the cannels from blockage.

The inner core 184 of the retaining ring 110 is formed of a rigid material, such as a metal, e.g., stainless steel, molybdenum, or aluminum, or a ceramic, e.g., alumina, or other exemplary materials. The material of the upper portion can have an elastic modulus of about $10–50\times10^6$ psi, i.e., about ten to one hundred times the elastic modulus of the material of the outer layer 180. For example, the elastic modulus of the outer layer 180 can be about $0.6\times10^6$ psi, the elastic modulus of the inner core 184 may be about $30\times10^6$ psi so that the ratio is about 50: 1.

With the retaining ring of the present invention, the rigidity of the inner core 184 of the retaining ring 10 increases the overall flexural rigidity of the retaining ring, e.g., by at least a factor of 30–40 times, as compared to a retaining ring formed entirely of a flexible material such as PPS. The increased rigidity provided by the rigid upper portion may reduce or eliminate the deformation caused by the attachment of the retaining ring to the base, thereby reducing the edge effect. Furthermore, the retaining ring may require less lapping after it is secured to the carrier head before achieving a stable polishing profile (this process is referred to as "break-in"). In addition, the outer layer 184 is inert in the CMP process and is sufficiently elastic to prevent chipping or cracking of the substrate edge. Furthermore, since the outer layer 180 is made of a material that can be easily redeposited, the cost of refurbishing the retaining ring can be reduced.

Another benefit of the increased rigidity of the retaining ring of the present invention is that it may reduce the sensitivity of the polishing process to pad compressibility. Without being limited to any particular theory, one possible contribution to the edge effect, particularly for flexible retaining rings, is what may be termed "deflection" of the retaining ring. Specifically, the force of the substrate edge on the inner surface of the retaining ring at the trailing edge of the carrier head may cause the retaining ring to deflect, i.e., locally twist slightly about an axis parallel to the surface of the polishing pad. This forces the inner diameter of the retaining ring more deeply into the polishing pad, generates increased pressure on the polishing pad and causes the polishing pad material to "flow" and be displaced toward the edge of the substrate. The displacement of the polishing pad material depends upon the elastic properties of the polishing pad. Thus, a relatively flexible retaining ring which can deflect into the pad may make the polishing process extremely sensitive to the elastic properties of the pad material. However, the increased rigidity provided by the rigid upper portion decreases the deflection of the retaining ring, thereby reducing pad deforniation, sensitivity to pad compressibility, and the edge effect.

In another implementation, the powder coating technique is a dry finishing process, using finely ground particles of pigment and resin which are electrostatically charged and sprayed onto the retaining ring to be coated, such as spraying.

A number of embodiments of the invention have been described. Nevertheless, it will be understood that various modifications may be made without departing from the spirit and scope of the invention. Accordingly, other embodiments are within the scope of the following claims.

What is claimed is:

1. A retaining ring for a carrier head, comprising:

an inner core of a first material, the inner core having a bottom surface, an inner surface, an outer surface and an upper surface; and an outer layer of a second, different material that is deposited on the first materials, wherein the outer layer contacts the bottom surface, at least a portion of the inner surface and at least a portion of the outer surface, and does not contact the upper portion.

2. The retaining ring of claim 1, wherein the outer layer is deposited on the inner core by spraying.

3. The retaining ring of claim 2, wherein the outer layer includes a bottom surface for contacting a polishing pad during polishing.

4. The retaining ring of claim 3, wherein the second material is less rigid than the first material.

5. The retaining ring of claim 4, wherein the second material is a polymer.

6. The retaining ring of claim 5, wherein the second material is polyetheretherketone.

7. The retaining ring of claim 5, wherein the first material is a metal.

8. A retaining ring for a carrier head, comprising:

an inner core made of a first material; and an outer layer of a second, different material that is configured to be refurbished by redeposition of the second, different material onto the outer layer.

9. The retaining ring of claim 8, wherein the outer layer includes a bottom surface for contacting a polishing pad during polishing.

10. A method for assembling a retaining ring for a carrier head, comprising:

providing an inner core of a first material; and depositing an outer layer of a second, different material onto an outer surface of the inner core, wherein the step of depositing includes spraying the second material on the first material.

11. The method of claim 10, wherein the outer layer provides a bottom surface for contacting a polishing pad during polishing.

12. The method of claim 10, wherein the second material comprises a polymer.

13. The method of claim 12, wherein the second material comprises polyethetherketone.

14. The method of claim 10, wherein the step of depositing comprises a dry finishing process.

15. A method for repairing a retaining ring of a carrier head, comprising:

providing a retaining ring having an inner core of a first material and an at least partially worn outer layer of a second, different material; and redepositing the second, different material on the worn outer layer of the retaining ring to refurbish the outer layer.

16. The method of claim 15, wherein the outer layer provides a bottom surface for contacting a polishing pad during polishing.

17. The method of claim 15, wherein the redepositing step includes spraying the second material onto the retaining ring.

18. A method for assembling a retaining ring for a carrier head, comprising:

providing an inner core of a first material; and depositing an outer layer of a second, different material onto an outer surface of the inner core, wherein the step of depositing includes a powder coating process.

19. The method of claim 18, wherein:

the outer layer provides a bottom surface for contacting a polishing pad during polishing.

20. The method of claim 18, wherein the second material comprises a polymer.

21. The method of claims 20, wherein the second material comprises polyetheretherketone.

* * * * *

UNITED STATES PATENT AND TRADEMARK OFFICE

CERTIFICATE OF CORRECTION

PATENT NO. : 6,835,125 B1 
DATED : December 28, 2004
INVENTOR(S) : Ming-Kuei Tseng, Michael Richter and Steven M. Zuniga It is certified that error appears in the above-identified patent and that said Letters Patent is hereby corrected as shown below:

Title page,
Item [75], Inventors, replace "Ming-Kuei Tseng, San Jose, CA (US)" with
-- Ming-Kuei Tseng, San Jose, CA (TW) --.
Item [73], Assignee, replace "Applied Materials Inc." with
-- Applied Materials, Inc. --.

Column 5,
Line 60, replace "materials" with --material --.

Column 6,
Line 62, replace "claims" with -- claim" --.

Signed and Sealed this

Twenty-first Day of February, 2006

JON W. DUDAS
*Director of the United States Patent and Trademark Office*